US012710005B2

(12) United States Patent
Fong

(10) Patent No.: US 12,710,005 B2
(45) Date of Patent: Aug. 18, 2026

(54) POST-COMBUSTION ENGINE EXHAUST GASES ABSORBER

(71) Applicant: Nkrumah Fong, Spanish town (JM)

(72) Inventor: Nkrumah Fong, Spanish town (JM)

( * ) Notice: Subject to any disclaimer, the term of this patent is extended or adjusted under 35 U.S.C. 154(b) by 0 days.

(21) Appl. No.: 18/674,543

(22) Filed: May 24, 2024

(65) Prior Publication Data

US 2024/0392712 A1 Nov. 28, 2024

Related U.S. Application Data

(60) Provisional application No. 63/504,130, filed on May 24, 2023.

(51) Int. Cl.
*F01N 3/08* (2006.01)

(52) U.S. Cl.
CPC ..... *F01N 3/0821* (2013.01); *F01N 2250/14* (2013.01)

(58) Field of Classification Search
CPC ..... F01N 2250/14; F01N 13/1894; F01N 2450/30; F01N 3/035; F01N 3/08
See application file for complete search history.

(56) References Cited

U.S. PATENT DOCUMENTS 3,988,113 A 10/1976 Roberts et al.
5,025,890 A * 6/1991 Hisashige ..... F01N 1/084 181/266
6,584,768 B1 7/2003 Hecker et al.
2005/0284115 A1 12/2005 Hung
2012/0288821 A1* 11/2012 Meyer ..... A61C 19/007 433/92

FOREIGN PATENT DOCUMENTS

CN 101518713 B * 7/2012
CN 103925048 A 7/2014
CN 210522061 U * 5/2020
CN 214972839 U * 12/2021
EP 0236295 B1 3/1989
JM 1801 10/2020

OTHER PUBLICATIONS

English Translation CN-101518713-B (Year: 2012).*
English Trasnlation CN-210522061-U (Year: 2020).*
English Trasnlation of CN-214972839-U (Year: 2021).*

* cited by examiner

*Primary Examiner* — Anthony Ayala Delgado

(57) ABSTRACT

A post-combustion engine exhaust gases absorber is an apparatus that scrubs greenhouse gas emissions and other pollutants from a post-tailpipe combustion engine exhaust. The apparatus reduces pollutants that could enter the atmosphere to reduce the environmental impact of the combustion engine. The apparatus includes an elongated housing, a distal dry filter, a biofilter, a distal motorized exhaust fan, a wet filter, a controller, and a portable power source. The elongated housing allows the apparatus to be attached to the exit of the combustion engine exhaust system. The distal dry filter, the biofilter, and the wet filter collectively remove the pollutants from the exhaust flow. The distal motorized exhaust fan drives the exhaust flow through the elongated housing so that the exhaust flow moves through the distal dry filter, the biofilter, and the wet filter. The controller and the portable power source enable the autonomous or semi-autonomous operation of the apparatus.

19 Claims, 12 Drawing Sheets

POST-COMBUSTION ENGINE EXHAUST GASES ABSORBER

The current application claims a priority to the U.S. provisional patent application Ser. No. 63/504,130 filed on May 24, 2023.

FIELD OF THE INVENTION

The present invention relates generally to carbon capture pollution control systems and air filtration systems. More specifically, the present invention discloses a system that directly captures, absorbs, and scrubs post-tailpipe-exhaust gases from a combustion engine (post-tailpipe/post-exhaust system) before being released into the atmosphere.

BACKGROUND OF THE INVENTION

Climate change is an ongoing environmental issue fueled by fossil fuel derivatives such as diesel, gasoline, plastic compounds, etc. With the advent of combustion engines as far back as the early 1900s, scientists have observed and have predicted continuous environmental degradation effects from rising Carbon Dioxide ($CO_2$) levels in the atmosphere. The impacts are particularly felt in oceans where acidity levels are noticeably increasing due to $CO_2$ absorption, impacting marine life at an alarming rate. In addition, humanity is at the cusp of a major turning point where the average above-surface temperatures can rise 1.5 degrees Celsius. The increase in global temperatures is directly correlated to the entrapment of various greenhouse gases such as $CO_2$, CO, and Methane, and various other gases generated from the use of fossil fuels. If these environmental impacts are to be averted or slowed to any substantial degree, then the implementation of carbon-capturing technologies in the sources of greenhouse gas emissions is necessary.

Therefore, an objective of the present invention is to provide a post-combustion engine exhaust gases absorber capable of directly capturing and absorbing the exhaust gases from the exhaust system of a combustion engine in order to reduce greenhouse gas emissions. The present invention provides a filtration and absorption system that removes greenhouse gases and other pollutants from the exhaust gases of a combustion engine. Another objective of the present invention is to provide a post-combustion engine exhaust gases absorber that can be installed in a vehicle to capture all exhaust gases from the vehicle's exhaust. The present invention can be designed as a retrofittable system that can be installed on an existing vehicle. In addition, the present invention can also be integrated into the vehicle's structure so that the present invention is part of the vehicle. Another objective of the present invention is to provide a post-combustion engine exhaust gases absorber that can be operated independently from the vehicle's system or work along with the vehicle's system. The present invention can work independently by including a separate power source or can operate along with the vehicle's system and share the vehicle's power system. Additional features and benefits of the present invention are further discussed in the sections below.

SUMMARY OF THE INVENTION

The present invention discloses a post-combustion engine exhaust gases absorber that scrubs any combustion-related exhaust to remove greenhouse gases and other pollutants from the exhaust flow. To do so, the present invention includes a series of dry filters designed to capture and remove various pollutants and particulates from the exhaust flow. The dry filters of the present invention can include different types of mediums of various porosity, sizes, textures, and thicknesses to ensure that the desired pollutants are removed. In addition, the present invention can include a wet absorption chamber that exposes the exhaust flow to a reaction solution that makes any Carbon Dioxide ($CO_2$) in the exhaust gases react and dissolve into the reaction solution. Other exhaust gases can also react with the reaction solution to create a mixture of dissolved salts which remain in the reaction solution. Further, the present invention can also include several suction fans that drive the exhaust flow through the system. By utilizing the physiochemical principles of filtration and chemical absorption to trap $CO_2$ within the system, the original composition of the gas mixture is reduced by 30% to 90% of the original volume of exhaust gas. Further, the present invention can operate along the combustion engine and utilize the same power source as the combustion engine. Alternatively, the present invention can include dedicated power sources that allow the system to operate independently. Additional filtration devices can be included to improve the scrubbing capabilities of the system.

DETAILED DESCRIPTIONS OF THE INVENTION

Figure 1:
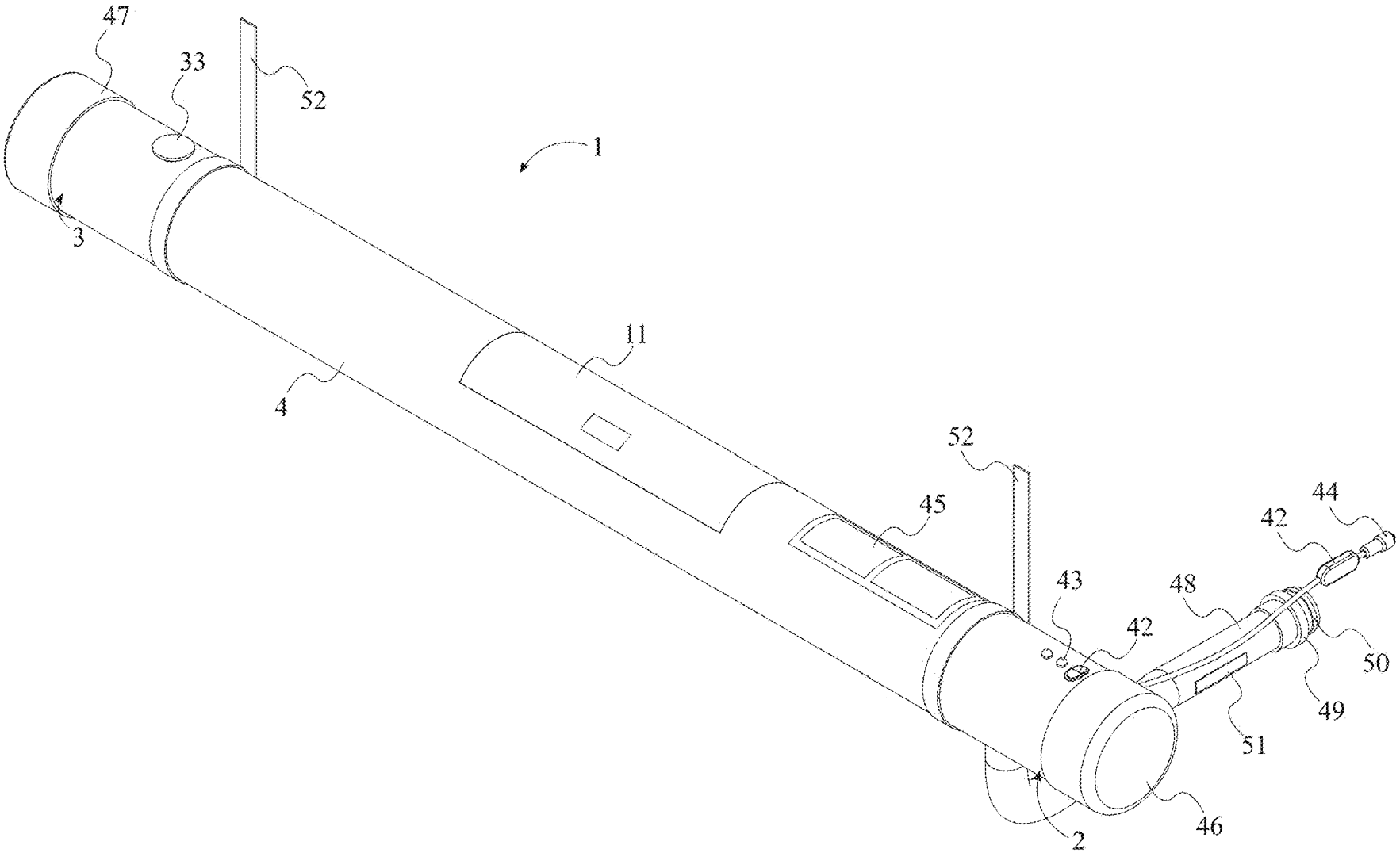
FIG. 1 is a top-front perspective view of the present invention.
Figure 2:
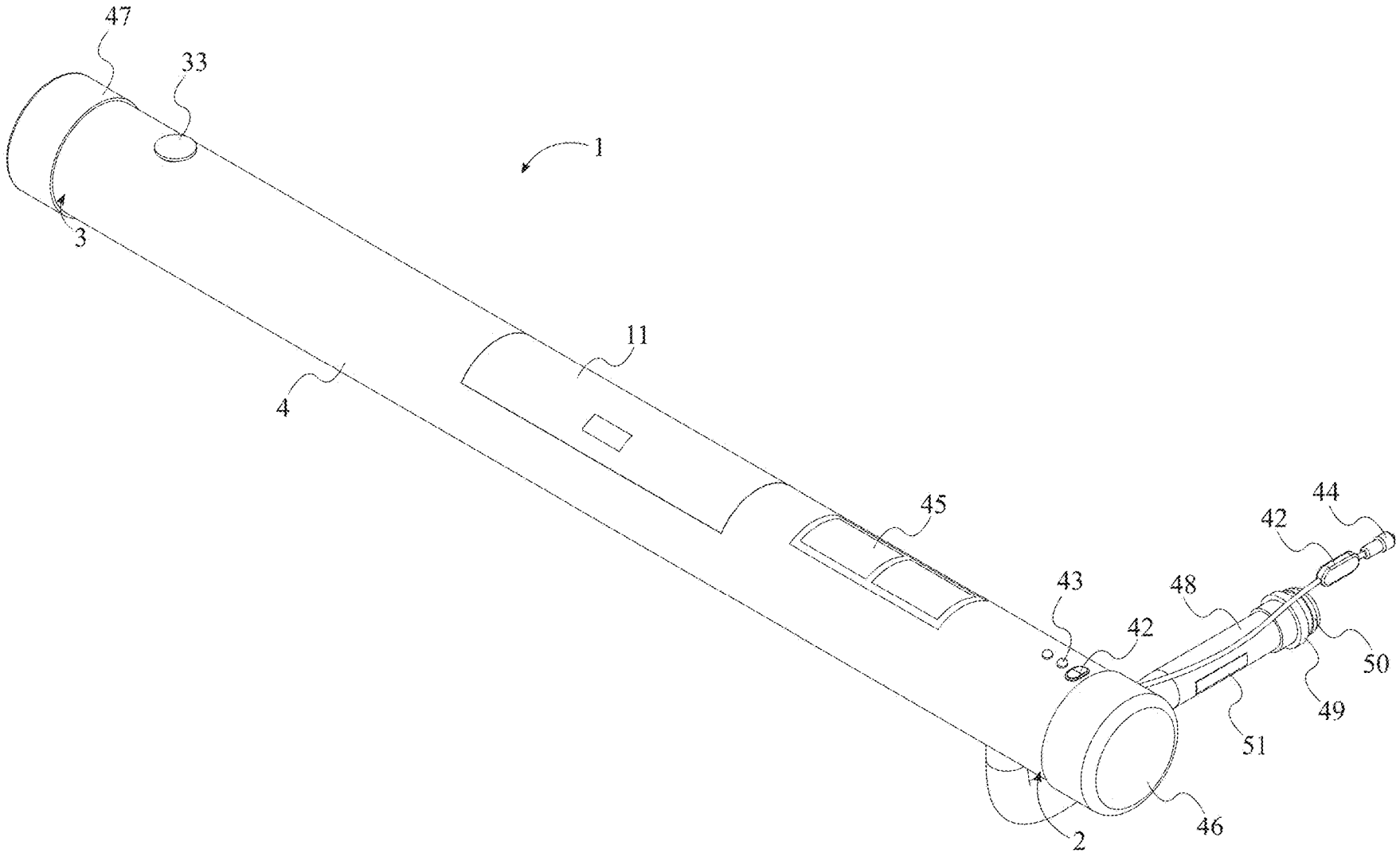
FIG. 2 is a top-front perspective view thereof, wherein the present invention is shown without vehicle-attachment mechanisms.
Figure 3:
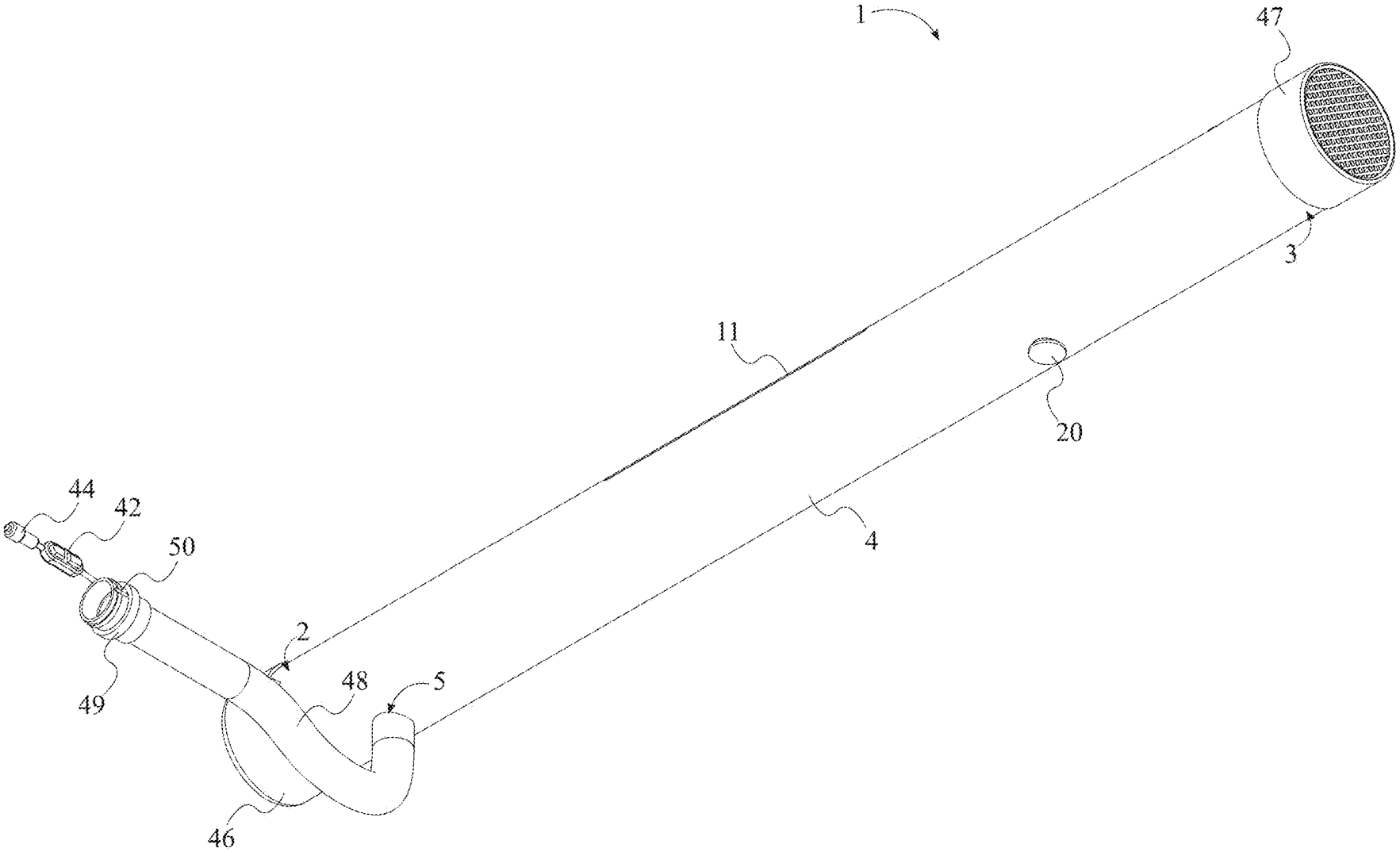
FIG. 3 is a bottom-rear perspective view thereof.
Figure 4:
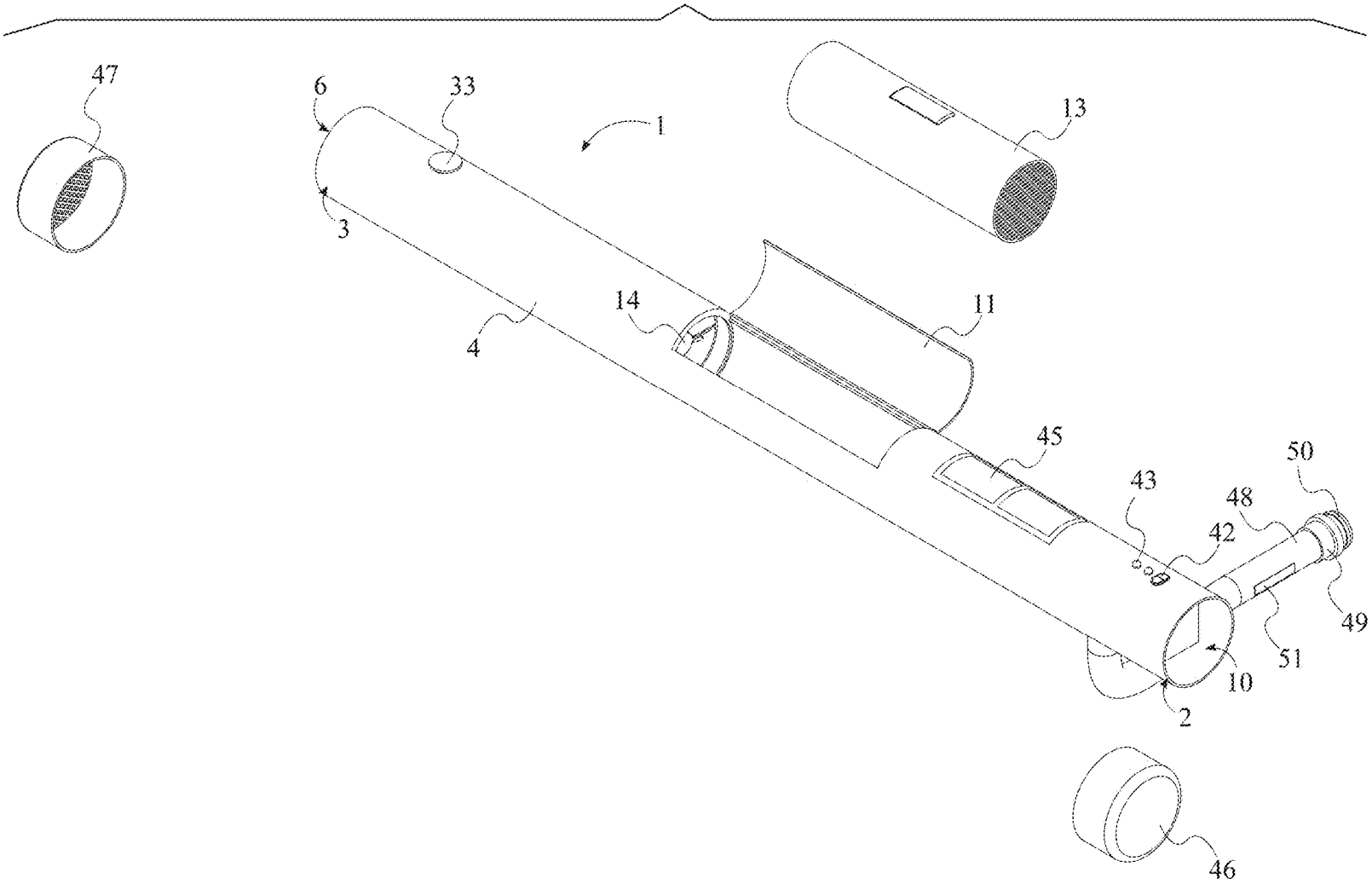
FIG. 4 is a top-front-exploded perspective view thereof.
Figure 5:
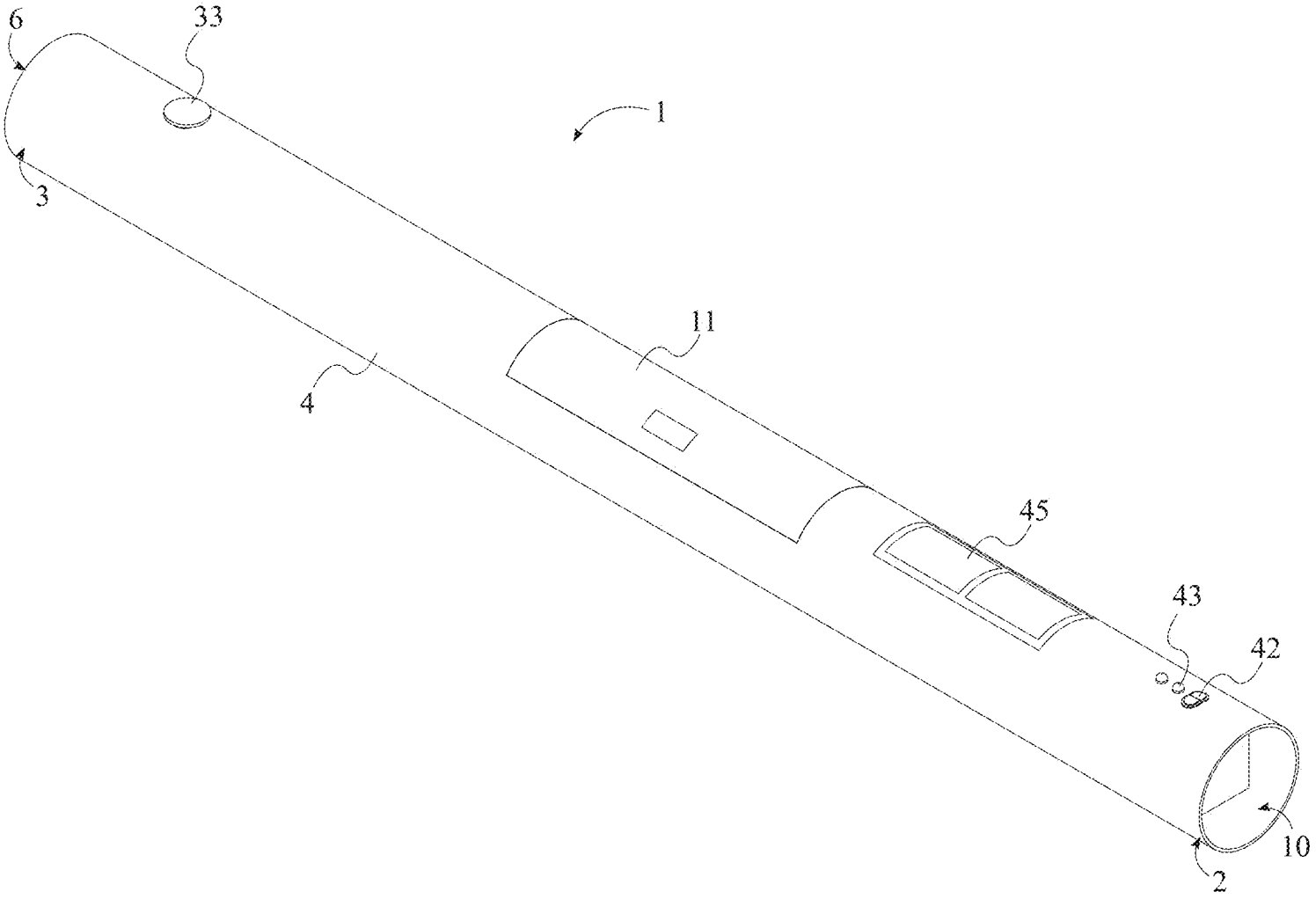
FIG. 5 is a top-front perspective view thereof, wherein the present invention is shown without a proximal contiguous cap, a distal perforated cap, nor an inlet thermoresistant hose.
Figure 6:
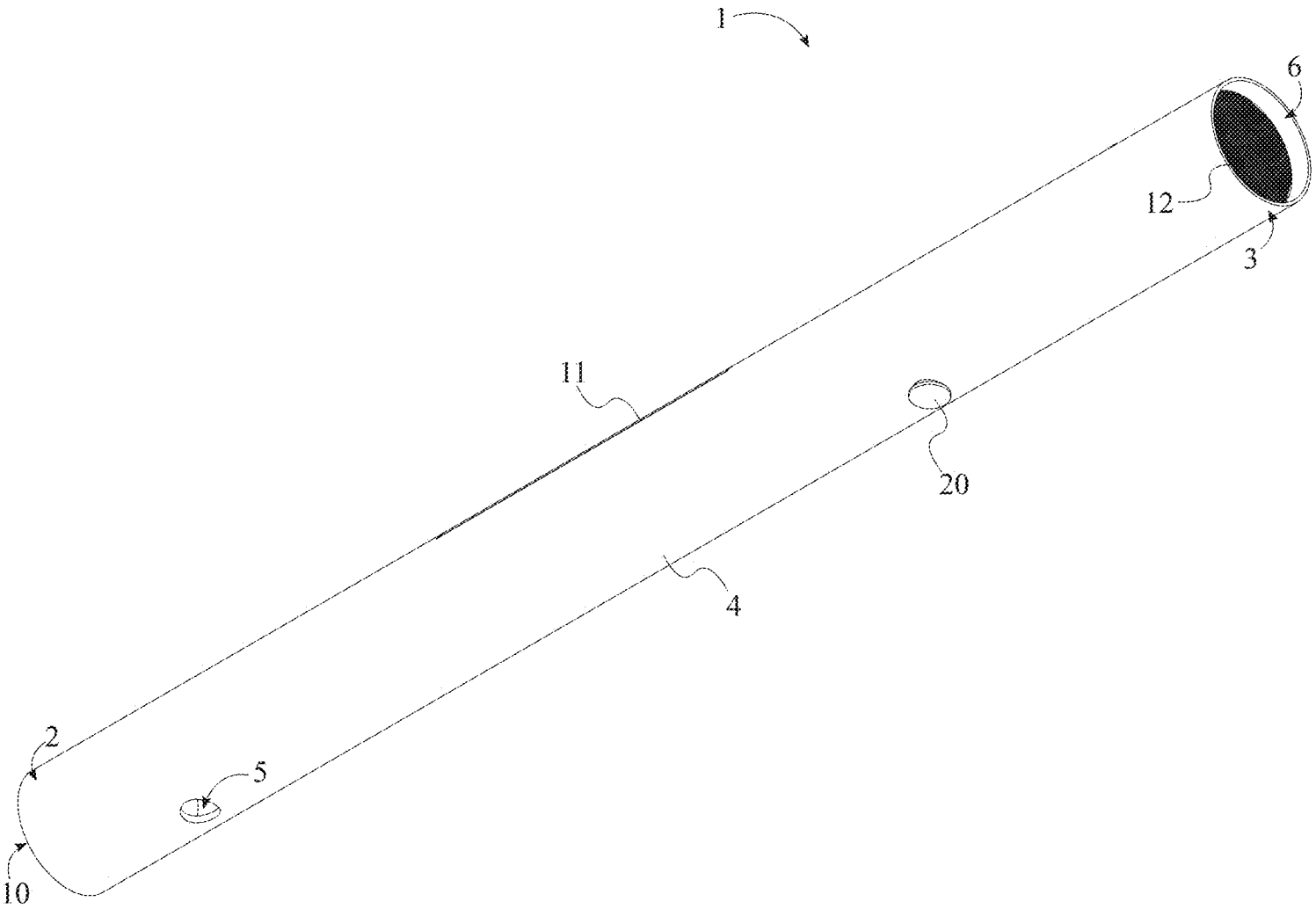
FIG. 6 is bottom-rear perspective view thereof.
Figure 7:
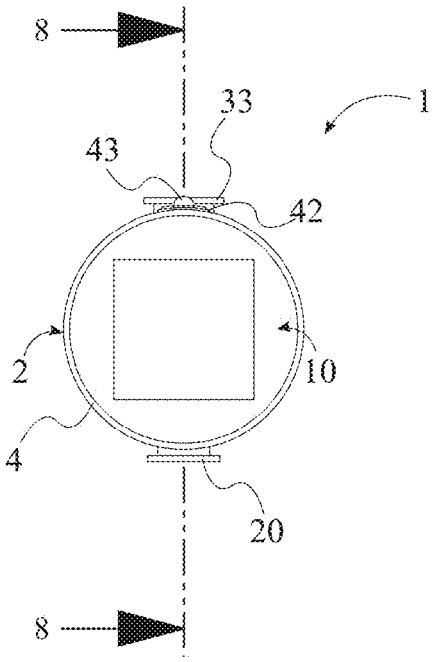
FIG. 7 is a side view thereof.
Figure 8:
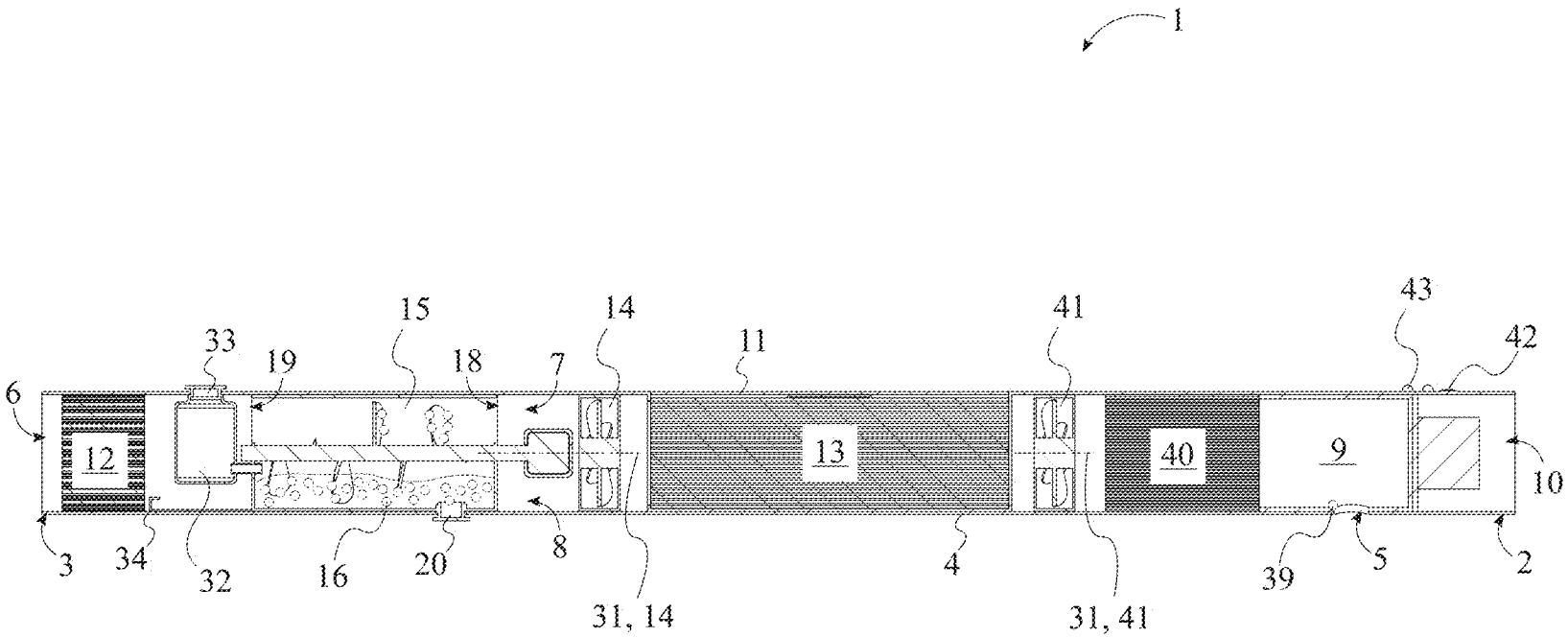
FIG. 8 is a vertical-cross-sectional view of the present invention taken along line 8-8 shown in FIG. 7.
Figure 9:
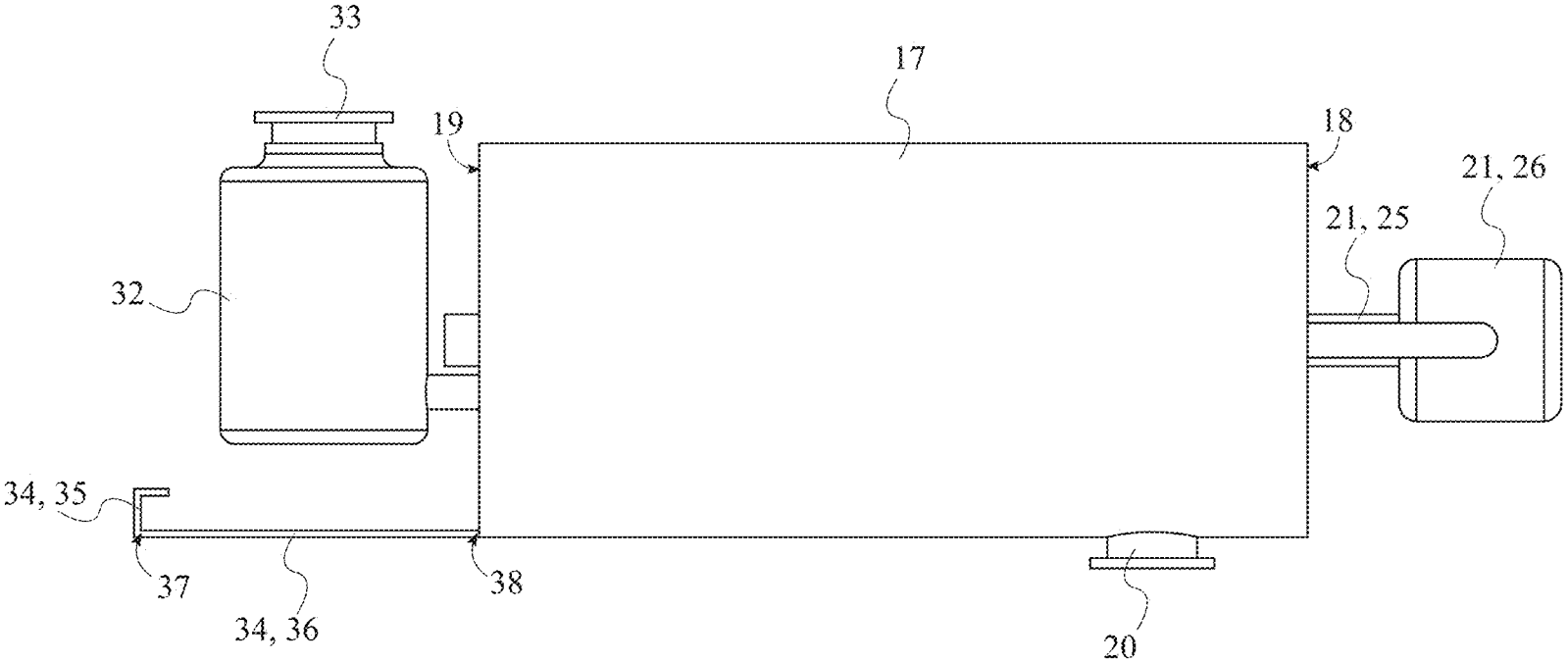
FIG. 9 is a front view of the wet filter, the solution reservoir, and the chamber-removing mechanism of the present invention.
Figure 10:
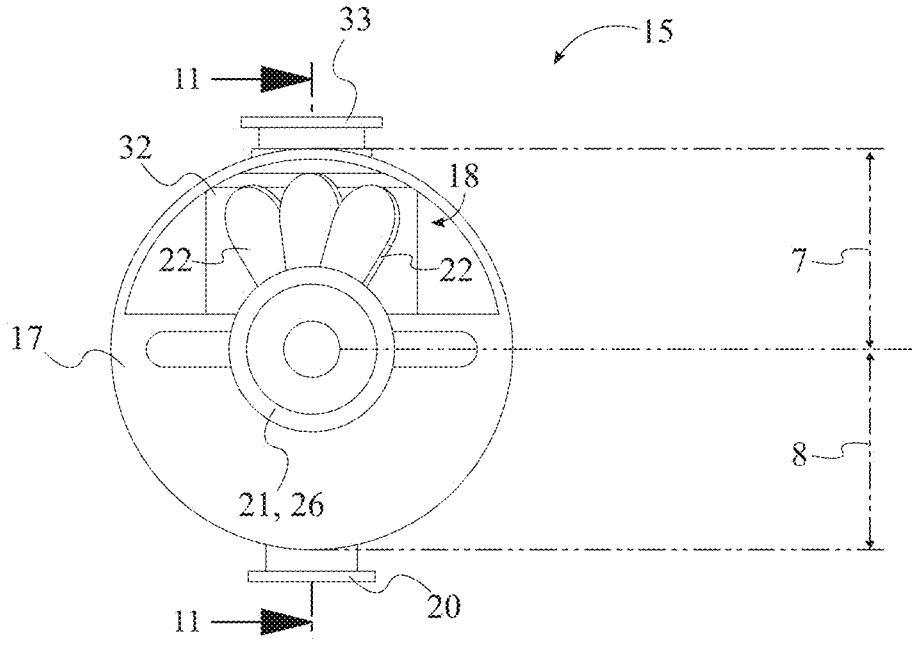
FIG. 10 is a side view thereof.
Figure 11:
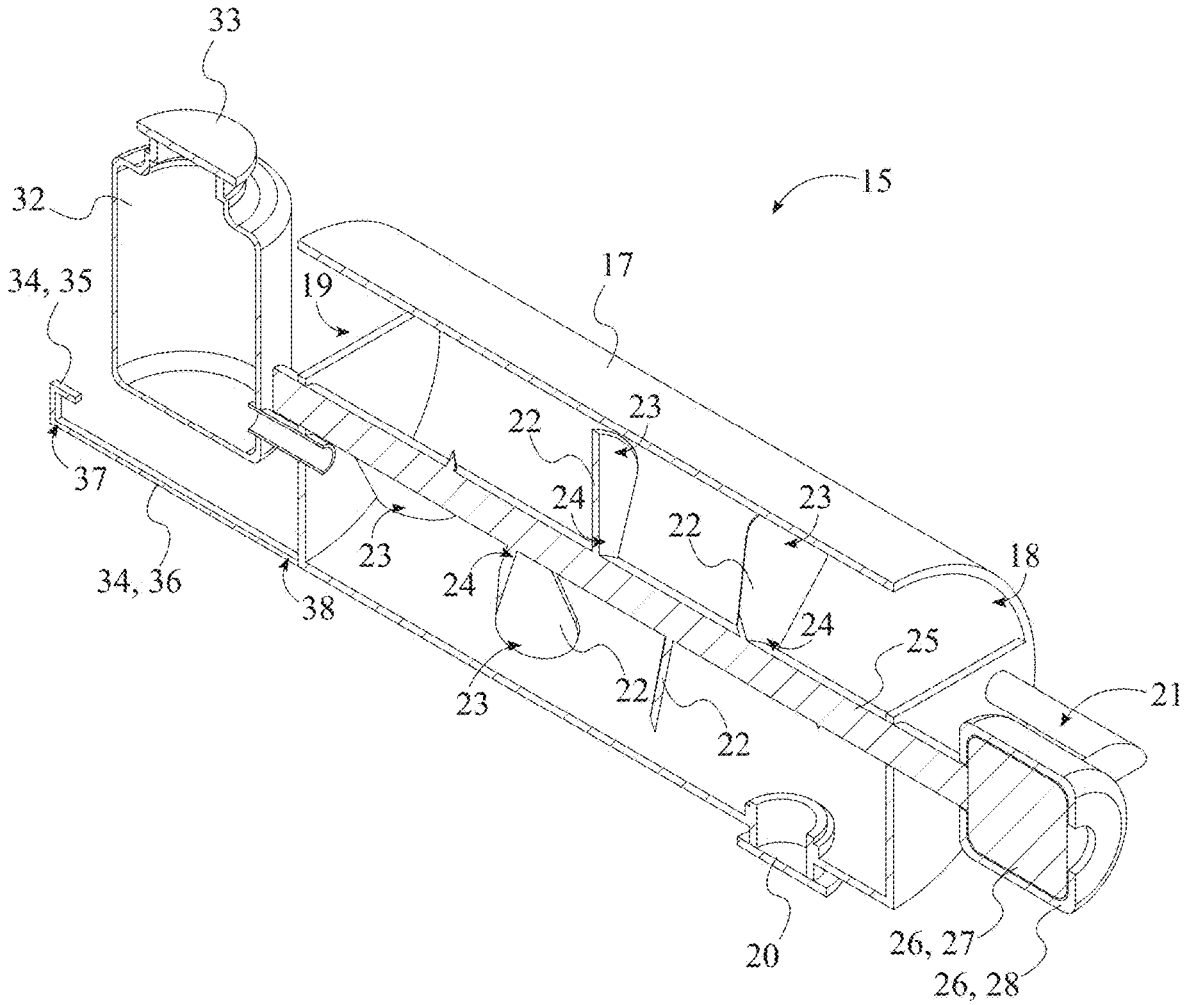
FIG. 11 is a vertical-cross-sectional perspective view of the present invention taken along line 11-11 shown in FIG. 10.
Figure 12:
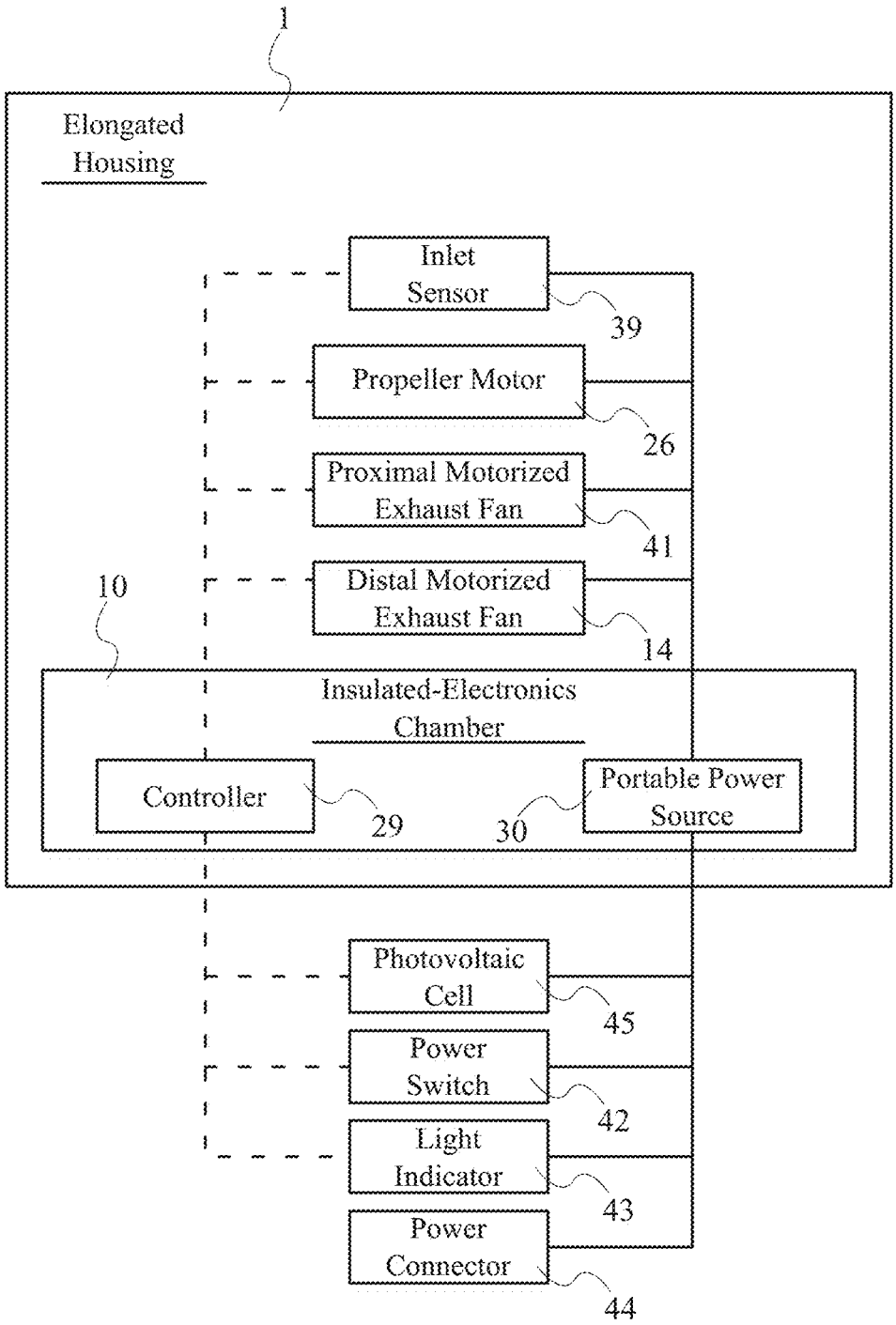
FIG. 12 is a schematic view of the electrical connections and the electronic connections of the present invention, wherein the electrical connections are shown in solid lines, and wherein the electronic connections are shown in dashed lines.

All illustrations of the drawings are for the purpose of describing selected versions of the present invention and are not intended to limit the scope of the present invention.

The present invention discloses a post-combustion engine exhaust gases absorber that scrubs greenhouse gas emissions and other pollutants from a combustion engine exhaust. The present invention helps reduce pollutants that could enter the atmosphere to vastly reduce the environmental impact of the combustion engine. As can be seen in FIGS. 1 through 8 and 12, the present invention may comprise an elongated housing 1, a distal dry filter 12, at least one biofilter 13, a distal motorized exhaust fan 14, a wet filter 15, a controller 29, and a portable power source 30. The elongated housing 1 serves to safely retain the various components of the present invention. In addition, the elongated housing 1 allows the present invention to be attached to the structure housing the combustion engine. The distal dry filter 12, the at least one biofilter 13, and the wet filter 15 help remove the desired pollutants from the exhaust flow generated by the combustion engine. The distal motorized exhaust fan 14 helps to drive the exhaust flow through the elongated housing 1 so that the exhaust flow passes through the distal dry filter 12, the at least one biofilter 13, and the wet filter 15. The controller 29 and the portable power source 30 enable autonomous or semi-autonomous operation of the present invention.

The general configuration of the present invention enables the automatic scrubbing of pollutants from the exhaust of a combustion engine. As can be seen in FIGS. 1 through 8 and 12, the elongated housing 1 is designed to fit all components of the present invention in a compact manner while enabling the elongated housing 1 to be installed on the structure housing the combustion engine. In the preferred embodiment, the elongated housing 1 is designed to be externally mounted onto the exterior frame of a vehicle with a combustion engine. To do so, the elongated housing 1 is preferably designed as an elongated cylindrical housing large enough to fit on the rear bumper structure of the desired vehicle. In this embodiment, the elongated housing 1 comprises a first housing end 2, a second housing end 3, a lateral housing wall 4, a proximal housing inlet 5, and a distal housing outlet 6. The first housing end 2 and the second housing end 3 correspond to the terminal ends of the elongated housing 1 while the lateral housing corresponds to the elongated cylindrical wall of the elongated. Further, the proximal housing inlet 5 corresponds to the structure on the elongated housing 1 through which the exhaust flow enters the elongated housing 1. On the other hand, the distal housing outlet 6 corresponds to the structure on the elongated housing 1 through which the filtered exhaust flow exits the elongated housing 1. In other embodiments, different designs for the elongated housing 1 can be implemented to accommodate different vehicles or structures housing the combustion engine exhaust system.

As can be seen in FIGS. 1 through 8 and 12, in the preferred embodiment, the present invention can be arranged as follows: the proximal housing inlet 5 is integrated into the lateral housing wall 4, adjacent to the first housing end 2, to allow the exhaust flow to enter the elongated housing 1. On the other hand, the distal housing outlet 6 is integrated into the second housing end 3 to allow the filtered exhaust flow to exit the elongated housing 1 through the second housing end 3. Further, the at least one biofilter 13, the distal motorized exhaust fan 14, the wet filter 15, and the distal dry filter 12 are positioned within the lateral housing wall 4 so that each is retained within the elongated housing 1. This way, the exhaust flow through the elongated housing 1 is exposed to the at least one biofilter 13, the distal motorized exhaust fan 14, the wet filter 15, and the distal dry filter 12. Further, the distal motorized exhaust fan 14 is rotatably mounted to the lateral housing wall 4 to secure the distal motorized exhaust fan 14 to the interior of the elongated housing 1. In addition, a rotation axis 31 of the distal motorized exhaust fan 14 is positioned parallel along a length of the elongated housing 1. This way, the exhaust flow is directed along the elongated housing 1.

As can be seen in FIGS. 1 through 8 and 12, further, the proximal housing inlet 5, the at least one biofilter 13, the distal motorized exhaust fan 14, the wet filter 15, the distal dry filter 12, and the distal housing outlet 6 are in serial fluid communication with each other. In other words, as the exhaust flow enters the elongated housing 1 the proximal housing inlet 5, the distal motorized exhaust fan 14 moves the exhaust flow through the at least one biofilter 13, the wet filter 15, and through the distal dry filter 12 before exiting the elongated housing 1 through the distal housing outlet 6. Further, the distal motorized exhaust fan 14 is electronically connected to the controller 29 to enable the controlled operation of the present invention. In addition, the distal motorized exhaust fan 14 and the controller 29 are electrically connected to the portable power source 30 to receive the power necessary for the operation of each component. In other embodiments, different arrangements of the components can be implemented according to different shapes and sizes of the elongated housing 1.

As can be seen in FIGS. 1 through 8 and 12, in the preferred embodiment, the different filters of the present invention allow a strategical removal of pollutants from the exhaust flow during the scrubbing process. For example, the at least one biofilter 13 reduces the amount of soot that gets into the wet filter 15. The at least one biofilter 13 can be made from seaweed or coconut husk fiber that is dried out, flattened, and wrapped between recyclable paper. The at least one biofilter 13 does not restrict the exhaust flow but encloses the exhaust flow slightly to ensure the soot becomes trapped while still allowing the exhaust flow to freely move through the elongated housing 1. The distal dry filter 12 helps remove any residual pollutants from the exhaust flow before exiting the elongated housing 1 through the distal housing outlet 6. For example, the at least one dry filter can be made from biodegradable filter paper, and the pore size of the at least one biofilter 13 can be smaller than the pore size of the distal dry filter 12. In other embodiments, various filter mediums can be implemented in the present invention that have fibrous or porous structure are sufficient and may vary between 25 nanometers (nm) to 50 nm.

As previously discussed, the wet filter 15 allows the removal of pollutants from the exhaust flow by exposing the exhaust flow to a reaction solution. As can be seen in FIGS. 7 through 12, the wet filter 15 may comprise a quantity of filtration solution 16, a filtration chamber 17, and a motorized filtration propeller 21. The quantity of filtration solution 16 corresponds to the reaction solution that reacts with the pollutants in the exhaust flow to remove the pollutants from the exhaust flow. For example, the quantity of filtration solution 16 can be designed to help remove the pollutants from the exhaust flow by facilitating a physical reaction that solidifies the pollutants in the exhaust flow. Then, the precipitated pollutants can be safely discarded. In other embodiments, different filtration/reaction solutions can be used to cause the absorption of the exhaust gases into the solution. For example, the solution may be a simple caustic solution composed of 20-50% Sodium Hydroxide by volume in water or a mixture of other hydroxides such as Potassium-Sodium Hydroxide mixtures or other basic hydroxide mixtures. The filtration chamber 17 corresponds to the structure that retains the quantity of filtration solution 16 and supports the operation of the motorized filtration propeller 21. The motorized filtration propeller 21 facilitates the exposure of the exhaust flow to a certain quantity of filtration solution 16. Furthermore, the filtration chamber 17 may comprise a chamber air inlet 18 and a chamber air outlet 19 corresponding to openings of the filtration chamber 17 through which the exhaust gases can flow into and out of the filtration chamber 17, respectively.

As can be seen in FIGS. 7 through 12, in the preferred embodiment, the wet filter 15 can be arranged as follows: the chamber air inlet 18 is positioned adjacent to the distal motorized exhaust fan 14 so that the exhaust flow moves into the filtration chamber 17 after the exhaust flow passes through the at least one biofilter 13. In addition, the chamber air inlet 18 is terminally integrated into filtration chamber 17 to provide an opening through which the exhaust flow can move into the filtration chamber 17. On the other hand, the chamber air outlet 19 is positioned adjacent to the distal dry filter 12 so that the exhaust flow moves through the distal dry filter 12 after passing through the filtration chamber 17. In addition, the chamber air outlet 19 is also terminally integrated into the filtration chamber 17, opposite to the chamber air inlet 18, so that the exhaust flow can move out of the filtration chamber 17. Further, the motorized filtration propeller 21 is rotatably mounted within the filtration chamber 17 so that the motorized filtration propeller 21 can rotate inside the filtration chamber 17. Further, the quantity of filtration solution 16 is positioned within the filtration chamber 17. In addition, the chamber air inlet 18 and the chamber air outlet 19 is positioned adjacent to a gravitationally-highest portion 7 of the elongated housing 1, while the quantity of filtration solution 16 is positioned adjacent to a gravitationally-lowest portion 8 of the elongated housing 1. This way, the quantity of filtration solution 16 remains within the filtration chamber 17 when the motorized filtration propeller 21 moves the quantity of filtration solution 16 inside the filtration chamber 17.

As previously discussed, the motorized filtration propeller 21 facilitates the exposure of the exhaust flow to the quantity of filtration solution 16. As can be seen in FIGS. 7 through 12, the motorized filtration propeller 21 may comprise a plurality of propeller blades 22, a propeller shaft 25, and a propeller motor 26. The plurality of propeller blades 22 corresponds to several blades that mix the flowing exhaust gases with the quantity of filtration solution 16 to expose the exhaust flow moving through the filtration chamber 17 to the quantity of filtration solution 16. The propeller shaft 25 keeps the plurality of propeller blades 22 rotating within the filtration chamber 17 by the torque generated by the propeller motor 26. To generate the torque necessary for the rotation of the plurality of propeller blades 22 within the filtration chamber 17, the propeller motor 26 may comprise a rotor 27 and a stator 28. Further, each of the plurality of propeller blades 22 comprises a proximal blade end 23 and a distal blade end 24 corresponding to the terminal ends of each propeller blade.

As can be seen in FIGS. 7 through 12, in the preferred embodiment, the motorized filtration propeller 21 may be arranged as follows: the proximal blade end 23 for each of the plurality of propeller blades 22 is terminally connected to the propeller shaft 25 so that each propeller blade is secured to the propeller shaft 25. Further, the plurality of propeller blades 22 is distributed about the propeller shaft 25 to spread the propeller blades about the circumference of the propeller shaft 25 to maximize the absorption rate of the turbulent exhaust gases. In addition, the plurality of propeller blades 22 is distributed along the propeller shaft 25 to also spread the propeller blades along the length of the propeller shaft 25. Further, the stator 28 is mounted external to the filtration chamber 17 to secure the propeller motor 26 to the exterior of the filtration chamber 17 to not obstruct the plurality of propeller blades 22. In addition, the propeller shaft 25 is hermetically protruding through the filtration chamber 17 so that the propeller motor 26 can be connected to the propeller shaft 25. Furthermore, the propeller shaft 25 is torsionally connected to the rotor 27 so that the torque generated by the propeller motor 26 is transferred to the propeller shaft 25. This way, as the propeller motor 26 rotates the propeller shaft 25, the plurality of propeller blades 22 is rotated within the filtration chamber 17 so that each propeller blade is coated in the quantity of filtration solution 16 as the propeller blades rotate about the propeller shaft 25. Then, as the exhaust gases move through the filtration chamber 17, the exhaust gases can react with the filtration solution through a direct absorption reaction with the solution. This is due to the turbulent nature of the filtration solution which allows for mass transfer of gases and other particulates into the solution until a state of equilibrium is obtained due to the propeller blades in order to remove the desired pollutants from the exhaust flow.

In the preferred embodiment, the present invention is designed to help the user maintain the wet filter 15 with enough filtration solution for the wet filter 15 to remove the desired pollutants from the exhaust flow through an absorption process which takes places in the chamber of the wet filter 15. In addition, the present invention is designed to enable the removal of used filtration solution, also referred to as the spent solution, containing a portion of the removed pollutants. As can be seen in FIGS. 7 through 12, the present invention may further comprise a solution reservoir 32 that retains an amount of clean filtration solution outside the filtration chamber 17 to replenish the quantity of filtration solution 16 in the filtration chamber 17. The solution reservoir 32 acts as a feeding mechanism buffer that refills the filtration solution in the filtration chamber 17 after the solution levels in the filtration chamber 17 fall under a predetermined threshold. In addition, the solution reservoir 32 comprises a refilling inlet 33 that allows the user to refill the solution reservoir 32. Further, the filtration chamber 17 may further comprise a draining outlet 20 that allows the used or spent filtration solution to be removed from the filtration chamber 17.

As can be seen in FIGS. 7 through 12, the solution reservoir 32 can be arranged as follows: The solution reservoir 32 is positioned adjacent to the chamber air outlet 19 so that the solution reservoir 32 does not block the exhaust flow moving through the filtration chamber 17. In addition, the solution reservoir 32 is mounted within the lateral housing wall 4 to secure the solution reservoir 32 within the elongated housing 1. Further, the solution reservoir 32 is in fluid communication with the filtration chamber 17 to enable the flow of filtration solution from the solution reservoir 32 into the filtration chamber 17. A valve or other flow regulators can be implemented in the connection to control the solution flow from the solution reservoir 32 to the filtration chamber 17. Further, the refilling inlet 33 is laterally integrated into the solution reservoir 32, adjacent to the gravitationally-highest portion 7 of the elongated housing 1, so that when the user refills the solution reservoir 32, the filtration solution flows down into the solution reservoir 32 without leaking. On the other hand, the draining outlet 20 is laterally integrated into the filtration chamber 17, adjacent to the gravitationally-lowest portion 8 of the elongated housing 1, so that the used filtration solution can be drained from the filtration chamber 17. Furthermore, the refilling inlet 33 and the draining outlet 20 hermetically protrude through the elongated housing 1 to prevent any leaks through the elongated housing 1.

As previously discussed, the present invention enables the user to perform maintenance on the wet filter 15. However, due to the elongated design of the elongated housing 1, the user may have difficulties removing the wet filter 15 for maintenance. As can be seen in FIGS. 7 through 12, to facilitate the installation and maintenance of the wet filter 15, the present invention may further comprise a chamber-removing mechanism 34. The chamber-removing mechanism 34 is a mechanical device that allows the user to reach into the elongated housing 1 to perform maintenance on the wet filter 15. So, the chamber-removing mechanism 34 comprises a pull tab 35 and a pull arm 36. The pull tab 35 provides the user a means to engage the chamber-removing mechanism 34. The pull arm 36 offsets the pull tab 35 from the wet filter 15 so that the chamber-removing mechanism 34 can be reached from outside the elongated housing 1. The pull arm 36 is preferably a strip of plastic that connects directly to the chamber of the wet filter 15 to allow for the removal using a sliding motion when pulled. So, the pull arm 36 comprises a first arm end 37 and a second arm end 38 corresponding to the terminal ends of the pull arm 36. Further, the pull tab 35 is connected adjacent to the first arm end 37, offset to the chamber air outlet 19, to secure the pull tab 35 to the pull arm 36 adjacent to the distal housing outlet 6. Furthermore, the second arm end 38 is laterally connected to the filtration chamber 17, adjacent to the chamber air outlet 19, to secure the chamber-removing mechanism 34 to the filtration chamber 17. This way, the user can pull on the pull tab 35 to remove the wet filter 15 from the elongated housing 1. Likewise, the user can use the chamber-removing mechanism 34 to correctly position the wet filter 15 within the elongated housing 1 during reinstallation after the maintenance has been performed. In other embodiments, different mechanisms can be utilized to help the user perform maintenance on the wet filter 15.

As previously discussed, the quantity of filtration solution 16 is designed to react with the pollutants present in the exhaust flow. In the preferred embodiment, the quantity of filtration solution 16 can be selected from a group consisting of sodium hydroxide, potassium hydroxide, and a combination thereof. The pollutants present invention exhaust flow may include, but are not limited to, Carbon Dioxide ($CO_2$), Carbon Monoxide (CO), unburnt hydrocarbons, inorganic matter, unburnt Carbon and soot, Oxygen ($O_2$), Nitrogen ($N_2$), Nitrogen Dioxide ($NO_2$), Nitric Oxide (NO), Sulfur Dioxide ($SO_2$), and other trace gases typically found in combustion exhaust. The quantity of filtration solution 16 can be picked according to the pollutants to be removed from the exhaust flow. In other embodiments, different chemical compounds can be utilized for the quantity of filtration solution 16.

The present invention can be designed to operate under predetermined conditions. For example, the present invention can be configured to activate once exhaust gases start flowing into the elongated housing 1 through the proximal housing inlet 5. As can be seen in FIGS. 1 through 8 and 12, to help monitor the gas flow through the proximal housing inlet 5, the present invention may further comprise at least one inlet sensor 39. Since the exhaust gases are hot due to the combustion process, the at least one inlet sensor 39 can help monitor when the exhaust gases start flowing into the elongated housing 1 due to a rise in the temperature around the proximal housing inlet 5. For example, the at least one inlet sensor 39 can be a thermistor to measure the temperature adjacent to the proximal housing inlet 5 or a hygrometer to measure the moisture levels inside the elongated housing 1 adjacent to the proximal housing inlet 5. In addition, the at least one inlet sensor 39 can include several sensors that can be used to monitor the temperature and the humidity adjacent to the proximal housing inlet 5. So, the at least one inlet sensor 39 is positioned within the lateral housing wall 4 to secure the at least one inlet sensor 39 to the lateral housing wall 4. In addition, the at least one inlet sensor 39 is positioned adjacent to the proximal housing inlet 5 to measure the temperature and/or moisture levels within the elongated housing 1 adjacent to the proximal housing inlet 5. Further, the at least one inlet sensor 39 is electronically connected to the controller 29 to transmit the corresponding sensor signals to the controller 29. In addition, the at least one inlet sensor 39 is electrically connected to the portable power source 30 to receive the power necessary for the operation of the at least one inlet sensor 39. In other embodiments, different sensors can be implemented to help monitor the exhaust gases flow into the elongated housing 1.

As previously discussed, the exhaust gases flowing into the elongated housing 1 through the proximal housing inlet 5 are very hot due to the combustion process. As can be seen in FIGS. 1 through 8 and 12, to protect the elongated housing 1 from the high temperatures, the elongated housing 1 may further comprise a fire-resistant transition chamber 9. The fire-resistant transition chamber 9 preferably corresponds to the area within the elongated housing 1 that is adjacent to the proximal housing inlet 5. The fire-resistant transition chamber 9 is equipped with fire-resistant insulation material to protect the surroundings from the high temperatures of the inflow of exhaust gases. So, the fire-resistant transition chamber 9 is positioned within the lateral housing wall 4, offset from the first housing end 2, to protect the elongate housing and adjacent components from high temperatures of the exhaust gases. Further, the proximal housing inlet 5 is in fluid communication with the at least one biofilter 13 through the fire-resistant transition chamber 9 so that the exhaust gases flowing into the elongated housing 1 through the proximal housing inlet 5 are directed towards the at least one biofilter 13. In other embodiments, different safety features can be implemented into the elongated housing 1 for greater protection of the components of the preset invention.

As can be seen in FIGS. 1 through 8 and 12, to further protect the components of the invention from high temperatures, especially the electronic and electrical components, the elongated housing 1 may further comprise an insulated-electronics chamber 10. The insulated-electronics chamber 10 helps protect the electronic and electrical components from the high temperature of the hot exhaust gases flowing through elongated housing 1. To do so, the insulated-electronics chamber 10 is positioned within the lateral housing wall 4, adjacent to the first housing end 2, so that insulated-electronics chamber 10 does not block the exhaust flow through the elongated housing 1. Further, the controller 29 and the portable power source 30 re mounted within the insulated-electronics chamber 10 so that the controller 29 and the portable power source 30 are protected from the high temperatures. In other embodiments, different safety measures can be implemented to protect the controller 29 and/or the portable power source 30.

In some embodiments, additional filtration devices can be implemented to improve the filtration capabilities of the present invention. As can be seen in FIGS. 1 through 8 and 12, for example, the present invention may further comprise a proximal dry filter 40 and a proximal motorized exhaust fan 41. The proximal dry filter 40 further filters the desired pollutants from the exhaust flow. The proximal motorized exhaust fan 41 facilitates the exhaust flow through the elongated housing 1 due to the increased resistance created by the additional dry filter. So, the proximal dry filter 40 and the proximal motorized exhaust fan 41 can be implemented as follows: The proximal motorized exhaust fan 41 and the proximal dry filter 40 are positioned within the lateral housing wall 4 so that each component is protected within the elongated housing 1. Further, the proximal motorized exhaust fan 41 is rotatably mounted to the lateral housing wall 4 to secure the proximal motorized exhaust fan 41 within the elongated housing 1. In addition, a rotation axis 31 of the proximal motorized exhaust fan 41 is axially aligned with the rotation axis 31 of the distal motorized exhaust fan 14 so that the flow generated aligns with the length of the elongated housing 1. Further, the proximal housing inlet 5, the proximal dry filter 40, the proximal motorized exhaust fan 41, and the at least one biofilter 13 are in serial fluid communication with each other. This way, once the exhaust gases flow into the elongated housing 1 through the proximal housing inlet 5, the exhaust flow is drawn through the proximal dry filter 40 by the proximal motorized exhaust fan 41 and towards the at least one biofilter 13. Further, the proximal motorized exhaust fan 41 is electronically connected to the controller 29 so that the operation of the proximal motorized exhaust fan 41 is controlled via the controller 29 according to user input. Furthermore, the proximal motorized exhaust fan 41 is electrically connected to the portable power source 30 to provide the power necessary for the operation of the proximal motorized exhaust fan 41.

In the preferred embodiment, the present invention can provide different means for the user to control the operation of the different electrical and electronic components of the present invention. As can be seen in FIGS. 1 through 8 and 12, for example, the present invention may further comprise a power switch 42 and at least one light indicator 43. The power switch 42 enables the user to manually turn the present invention on or off as necessary, while the at least one light indicator 43 provides visual feedback to the user regarding different conditions of the present invention. To integrate the power switch 42 and the at least one light indicator 43, the power switch 42 and the at least one light indicator 43 re mounted external to the elongated housing 1, adjacent to the first housing end 2. This way, the power switch 42 and the at least one light indicator 43 are accessible from outside the elongated housing 1. In addition, the power switch 42 and the at least one light indicator 43 are electronically connected to the controller 29 so that the controller 29 can transmit the appropriate signals to each component. Furthermore, the power switch 42 and the at least one light indicator 43 are electrically connected to the portable power source 30 to provide the power necessary for the operation of each component. In an exemplary embodiment, the at least one light indicator 43 can be configured to indicate when the quantity of filtration solution 16 needs to be replaced. For example, as the quantity of filtration solution 16 is used and absorbs $CO_2$, the salts begin to form from the removed pollutants and the filtration solution needs to be emptied from the filtration chamber 17. As the motorized filtration propeller 21 slows down due to the solidified or precipitated pollutants in the filtration solution, the propeller motor 26 shuts off and the at least one light indicator 43 is activated to signal the user that maintenance is required. In other embodiments, different indicators can be implemented that could correspond to different events.

The portable power source 30 is designed to provide enough power so that each electronic and electrical component can operate. However, in some embodiments, the present invention can be powered from external power sources, such as the vehicle's battery or other power sources such as a miniature solar cell. As can be seen in FIGS. 1 through 8 and 12, the present invention may further comprise a power connector 44 that enables the portable power source 30 to be recharged from an external power source. In addition, the power switch 42 can be provided along the power connector 44 to enable the user to remotely activate the present invention. So, the power switch 42 and the at least one light indicator 43 are positioned external and offset to the elongated housing 1 so that the power connector 44 can be plugged into the external power source. For example, the power connector 44 can be designed to be plugged into the car lighter or any power port provided in the vehicle. Further, the power switch 42 is electronically connected to the controller 29 so that the user can remotely turn on or off the present invention from inside the vehicle. Furthermore, the power switch 42 and the power connector 44 are electrically connected to the portable power source 30.

In other embodiments, different power sources can be provided to help power the present invention. As can be seen in FIGS. 1 through 8 and 12, for example, the present invention may further comprise at least one photovoltaic cell 45 that allows the user to utilize renewable energy to power the electronic components and the electrical components of the present invention. The at least one photovoltaic cell 45 is mounted external to the elongated housing 1 to secure the at least one photovoltaic cell 45 to the elongated housing 1. Further, the at least one photovoltaic cell 45 is electrically connected to the portable power source 30 to enable the flow of generated electricity by the at least one photovoltaic cell 45 to the portable power source 30. In other embodiments, different renewable energy systems can be implemented to help power the present invention.

As can be seen in FIGS. 1 through 8 and 12, in the preferred embodiment, the present invention is provided with a proximal contiguous cap 46 that seals the first housing end 2 to protect the electronic components and the electrical components stored within the insulated-electronics chamber 10. The proximal contiguous cap 46 also enables the user to easily access the insulated-electronics chamber 10 for maintenance purposes. To do so, the proximal contiguous cap 46 is positioned external to the elongated housing 1 so that the user can access the proximal contiguous cap 46. Further, the proximal contiguous cap 46 is mounted around and across the first housing end 2 to fully seal the first housing end 2.

As can be seen in FIGS. 1 through 8 and 12, the present invention may further comprise a distal perforated cap 47 that allows the filtrated exhaust flow to exit the elongated housing 1. Like the proximal contiguous cap 46, the distal perforated cap 47 is designed so that the user can install or remove the distal perforated cap 47 as necessary. To do so, the distal perforated cap 47 is positioned external to the elongated housing 1 so that the user can have access to the distal perforated cap 47. Further, the distal perforated cap 47 is mounted around and across the distal housing outlet 6 so that the distal perforated cap 47 is secured around the distal housing outlet 6. In other embodiments, different scaling devices that allow through airflow can be implemented on the distal housing outlet 6.

In some embodiments, the present invention can provide means to perform maintenance on the various filters installed in the elongated housing 1. As can be seen in FIGS. 1 through 8 and 12, for example, the elongated housing 1 may further comprise a maintenance panel 11 that gives access to the inside of the elongated housing 1. The maintenance panel 11 is preferably designed to facilitate the maintenance of the at least one biofilter 13 but can be designed to facilitate the maintenance of the other dry filters.

To do so, the maintenance panel 11 is positioned external to the elongated housing 1 so that the user can have access to the maintenance panel 11. Further, the maintenance panel 11 is integrated into the elongated housing 1, adjacent to the at least one biofilter 13, to provide access to the at least one biofilter 13. For example, the maintenance panel 11 can be a hinged panel that conforms to the elongated housing 1. The maintenance panel 11 can also include a locking mechanism that allows the user to selectively open or close the maintenance panel 11. In other embodiments, different mechanisms can be used to access the interior of the elongated housing 1.

As previously discussed, the present invention is preferably designed to be installed on a vehicle to filtrate the exhaust gases generated by the vehicle's motor. As can be seen in FIG. 1, to help the user install the present invention to the desired vehicle, the present invention may further comprise an inlet thermoresistant hose 48, an inlet fitting 49, and a pipe clamp 50. The inlet thermoresistant hose 48 is designed to enable the connection of the proximal housing inlet 5 to the vehicle's exhaust. The inlet fitting 49 facilitates the connection of the inlet thermoresistant hose 48 to the vehicle's exhaust. The pipe clamp 50 is designed to secure the connection of the inlet thermoresistant hose 48 to the vehicle's exhaust. So, the inlet fitting 49 is in fluid communication with the proximal housing inlet 5 through the inlet thermoresistant hose 48. This way, the exhaust gases flowing out of the vehicle's exhaust is guided into the proximal housing inlet 5 via through the inlet fitting 49 and the inlet thermoresistant hose 48. Further, the pipe clamp 50 is mounted about the inlet fitting 49 to enable the user to secure the inlet fitting 49 onto the vehicle's exhaust.

As can be seen in FIGS. 1 through 4, in some embodiments, the inlet thermoresistant hose 48 can further include means to enable the exhaust gases to exit the inlet thermoresistant hose 48 before reaching the present invention in case of emergencies. This is helpful during emergencies or if any components of the present invention fail and the user cannot remove the inlet thermoresistant hose 48. To do so, the present invention may further comprise a simple gas-release mechanism 51 that can be selectively engaged to provide a free opening through which the exhaust gases can flow out of the inlet thermoresistant hose 48. For example, the gas-release mechanism 51 can be a slidable hatch that can be easily opened to allow exhaust gases to escape the inlet thermoresistant hose 48. So, the gas-release mechanism 51 is laterally integrated into the inlet thermoresistant hose 48 to enable the select release of the exhaust gases before reaching the proximal housing inlet 5. In other embodiments, different release mechanisms can be implemented that can automatically engage in predetermined conditions.

As can be seen in FIGS. 1 through 4, furthermore, to enable the user to install the present invention to the vehicle's structure, the present invention may further comprise at least one vehicle-attachment mechanism 52. The at least one vehicle-attachment mechanism 52 allows the removable attachment of the present invention to the vehicle's structure. For example, the at least one vehicle-attachment mechanism 52 can be a plurality of suspension cables that allows the elongated housing 1 to be attached to the vehicle's rear bumper. So, the at least one vehicle-attachment mechanism 52 is mounted external to the elongated housing 1 to secure the elongated housing 1 to the desired external structure. In other embodiments, different attachment mechanisms can be utilized to enable the elongated housing 1 to be secure to other structures.

Although the invention has been explained in relation to its preferred embodiment, it is to be understood that many other possible modifications and variations can be made without departing from the spirit and scope of the invention.

What is claimed is:

1. A post-combustion engine exhaust gases absorber comprising:

an elongated housing;

a distal dry filter;

at least one biofilter;

a distal motorized exhaust fan;

a wet filter;

a controller;

a portable power source;

the elongated housing comprising a first housing end, a second housing end, a lateral housing wall, a proximal housing inlet, and a distal housing outlet;

the wet filter comprising a quantity of filtration solution, a filtration chamber, and a motorized filtration propeller;

the filtration chamber comprising a chamber air inlet and a chamber air outlet;

the proximal housing inlet being integrated into the lateral housing wall, adjacent to the first housing end;

the distal housing outlet being integrated into the second housing end;

the at least one biofilter, the distal motorized exhaust fan, the wet filter, and the distal dry filter being positioned within the lateral housing wall;

the distal motorized exhaust fan being rotatably mounted to the lateral housing wall;

a rotation axis of the distal motorized exhaust fan being positioned parallel along a length of the elongated housing;

the proximal housing inlet, the at least one biofilter, the distal motorized exhaust fan, the wet filter, the distal dry filter, and the distal housing outlet being in serial fluid communication with each other;

the distal motorized exhaust fan being electronically connected to the controller;

the distal motorized exhaust fan and the controller being electrically connected to the portable power source;

the chamber air inlet being positioned adjacent to the distal motorized exhaust fan;

the chamber air inlet being terminally integrated into filtration chamber;

the chamber air outlet being positioned adjacent to the distal dry filter;

the chamber air outlet being terminally integrated into filtration chamber, opposite to the chamber air inlet;

the motorized filtration propeller being rotatably mounted within the filtration chamber;

the quantity of filtration solution being positioned within the filtration chamber;

the chamber air inlet and the chamber air outlet being positioned adjacent to a gravitationally-highest portion of the elongated housing; and the quantity of filtration solution being positioned adjacent to a gravitationally-lowest portion of the elongated housing.

2. The post-combustion engine exhaust gases absorber as claimed in claim 1, wherein a pore size of the at least one biofilter is smaller than a pore size of the distal dry filter.

3. The post-combustion engine exhaust gases absorber as claimed in claim 1 comprising:

the motorized filtration propeller comprising a plurality of propeller blades, a propeller shaft, and a propeller motor;

the propeller motor comprising a rotor and a stator;

each of the plurality of propeller blades comprising a proximal blade end and a distal blade end;

the proximal blade end for each of the plurality of propeller blades being terminally connected to the propeller shaft;

the plurality of propeller blades being distributed about the propeller shaft;

the plurality of propeller blades being distributed along the propeller shaft;

the stator being mounted external to the filtration chamber;

the propeller shaft hermetically protruding through the filtration chamber; and the propeller shaft being torsionally connected to the rotor.

4. The post-combustion engine exhaust gases absorber as claimed in claim 1 comprising:

a solution reservoir;

the solution reservoir comprising a refilling inlet;

the filtration chamber further comprising a draining outlet;

the solution reservoir being positioned adjacent to the chamber air outlet;

the solution reservoir being mounted within the lateral housing wall;

the solution reservoir being in fluid communication with the filtration chamber;

the refilling inlet being laterally integrated into the solution reservoir, adjacent to the gravitationally-highest portion of the elongated housing;

the draining outlet being laterally integrated into the filtration chamber, adjacent to the gravitationally-lowest portion of the elongated housing; and the refilling inlet and the draining outlet hermetically protruding through the elongated housing.

5. The post-combustion engine exhaust gases absorber as claimed in claim 1 comprising:

a chamber-removing mechanism;

the chamber-removing mechanism comprising a pull tab and a pull arm;

the pull arm comprising a first arm end and a second arm end;

the pull tab being connected adjacent to the first arm end, offset to the chamber air outlet; and the second arm end being laterally connected to the filtration chamber, adjacent to the chamber air outlet.

6. The post-combustion engine exhaust gases absorber as claimed in claim 1, wherein the quantity of filtration solution is selected from a group consisting of: sodium hydroxide, potassium hydroxide, and a combination thereof.

7. The post-combustion engine exhaust gases absorber as claimed in claim 1 comprising:

at least one inlet sensor;

the at least one inlet sensor being positioned within the lateral housing wall;

the at least one inlet sensor being positioned adjacent to the proximal housing inlet;

the at least one inlet sensor being electronically connected to the controller; and the at least one inlet sensor being electrically connected to the portable power source.

8. The post-combustion engine exhaust gases absorber as claimed in claim 1 comprising:

the elongated housing further comprising a fire-resistant transition chamber;

the fire-resistant transition chamber being positioned within the lateral housing wall, offset from the first housing end; and the proximal housing inlet being in fluid communication with the at least one biofilter through the fire-resistant transition chamber.

9. The post-combustion engine exhaust gases absorber as claimed in claim 1 comprising:

the elongated housing further comprising an insulated-electronics chamber;

the insulated-electronics chamber being positioned within the lateral housing wall, adjacent to the first housing end; and the controller and the portable power source being mounted within the insulated-electronics chamber.

10. The post-combustion engine exhaust gases absorber as claimed in claim 1 comprising:

a proximal dry filter;

a proximal motorized exhaust fan;

the proximal motorized exhaust fan and the proximal dry filter being positioned within the lateral housing wall;

the proximal motorized exhaust fan being rotatably mounted to the lateral housing wall;

a rotation axis of the proximal motorized exhaust fan being axially aligned with the rotation axis of the distal motorized exhaust fan;

the proximal housing inlet, the proximal dry filter, the proximal motorized exhaust fan, and the at least one biofilter being in serial fluid communication with each other;

the proximal motorized exhaust fan being electronically connected to the controller; and the proximal motorized exhaust fan being electrically connected to the portable power source.

11. The post-combustion engine exhaust gases absorber as claimed in claim 1 comprising:

a power switch;

at least one light indicator;

the power switch and the at least one light indicator being mounted external to the elongated housing, adjacent to the first housing end;

the power switch and the at least one light indicator being electronically connected to the controller; and the power switch and the at least one light indicator being electrically connected to the portable power source.

12. The post-combustion engine exhaust gases absorber as claimed in claim 1 comprising:

a power switch;

a power connector;

the power switch and the at least one light indicator being positioned external and offset to the elongated housing;

the power switch being electronically connected to the controller; and the power switch and the power connector being electrically connected to the portable power source.

13. The post-combustion engine exhaust gases absorber as claimed in claim 1 comprising:

at least one photovoltaic cell;

the at least one photovoltaic cell being mounted external to the elongated housing; and the at least one photovoltaic cell being electrically connected to the portable power source.

14. The post-combustion engine exhaust gases absorber as claimed in claim 1 comprising:

a proximal contiguous cap;

the proximal contiguous cap being positioned external to the elongated housing; and the proximal contiguous cap being mounted around and across the first housing end.

15. The post-combustion engine exhaust gases absorber as claimed in claim 1 comprising:

a distal perforated cap;

the distal perforated cap being positioned external to the elongated housing; and the distal perforated cap being mounted around and across the distal housing outlet.

16. The post-combustion engine exhaust gases absorber as claimed in claim 1 comprising:

the elongated housing further comprising a maintenance panel;

the maintenance panel being positioned external to the elongated housing; and the maintenance panel being integrated into the elongated housing, adjacent to the at least one biofilter.

17. The post-combustion engine exhaust gases absorber as claimed in claim 1 comprising:

an inlet thermoresistant hose;

an inlet fitting;

a pipe clamp;

the inlet fitting being in fluid communication with the proximal housing inlet through the inlet thermoresistant hose; and the pipe clamp being mounted about the inlet fitting.

18. The post-combustion engine exhaust gases absorber as claimed in claim 17 comprising:

a gas-release mechanism; and the gas-release mechanism being laterally integrated into the inlet thermoresistant hose.

19. The post-combustion engine exhaust gases absorber as claimed in claim 1 comprising:

at least one vehicle-attachment mechanism; and the at least one vehicle-attachment mechanism being mounted external to the elongated housing.

* * * * *